United States Patent [19]

Wright

[11] Patent Number: 4,577,770

[45] Date of Patent: Mar. 25, 1986

[54] TAMPER INDICATING SCREW CAP

[75] Inventor: David M. Wright, Evansville, Ind.

[73] Assignee: Sunbeam Plastics Corporation, Evansville, Ind.

[21] Appl. No.: 713,276

[22] Filed: Mar. 18, 1985

[51] Int. Cl.[4] ..... B65D 41/34

[52] U.S. Cl. ..... 215/252

[58] Field of Search ..... 215/252

[56] References Cited

U.S. PATENT DOCUMENTS 4,529,096 7/1985 Chartier et al. ..... 215/252

*Primary Examiner*—Donald F. Norton

*Attorney, Agent, or Firm*—Irvin L. Groh

[57] ABSTRACT

A threaded one piece closure having a tamper indicating ring attached to the lower end of the cap skirt by shear webs which fracture upon the initial opening of the closure leaving the detached ring on the container indicating the initial opening or tampering. The inner surface of the ring has a retaining bead which engages an annular flange on the container which restrains movement of the ring in the opening process. Cooperating drive means on the cap skirt and ring allow initial closure application to the container without fracture of the shear webs.

12 Claims, 4 Drawing Figures

TAMPER INDICATING SCREW CAP

This invention relates to tamper indicating closures and more specifically to closures in which a cap and ring are formed as a single piece and separate from each other upon an attempt to open the container, the separated ring giving evidence that the container has been opened or that an attempt has been made to open it.

Tamper indicating closures of the type having a separable ring which remains with the container upon opening of the container to indicate tampering by way of separation of the ring and the remainder of the closure have been provided in various forms. In one form, the closure must be applied in at least two steps, one of which requires the application of heat after the closure has been applied to a filled container to deform a skirt portion to lock into position relative to the container. In another form of one-piece tamper indicating closure, the closure and separable ring must be axially aligned to transmit capping or closing forces to prevent premature separation of the ring and the closure. Such constructions, however, are extremely difficult to mold and require complex molds and molding procedures. Still other of such one-piece tamper indicating closures require modification of the container to insure proper separation of the tamper indicating ring and the remainder of the closure.

In accordance with the present invention, a one-piece tamper indicating closure has been provided in which the closure can be applied to a container in a single step operation and in which the closure is made up of a cap and a separable ring in which the ring is concentric with the cap so that it is radially spaced outwardly therefrom. The cap and ring are provided with driving and driven surfaces which engage each other to transmit both circumferential and axial loads preventing premature breakage and separation of the ring from the remainder of the closure. Such a construction permits more simplified molding techniques and molds while at the same time accomplishing all of the advantages of a tamper indicating closure in which a ring separates from the cap portion and remains with the container to indicate that there has been prior opening of the container.

The preferred embodiments of the invention are illustrated in the drawing in which.

A tamper indicating closure embodying the invention is designated generally at 10 is formed in a single piece and is intended for use on a container 12 having external threads 14 on a neck 16 which is formed with an annular flange 18 disposed below the external threads 14.

Figure 1:
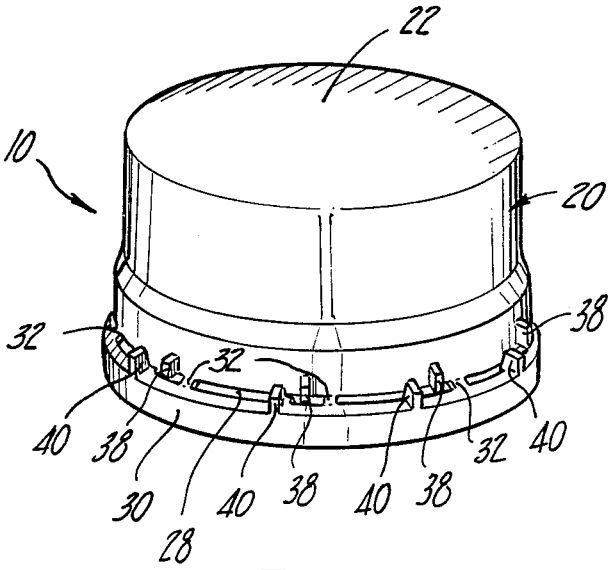
FIG. 1 is a perspective view of the closure embodying the present invention.
Figure 2:
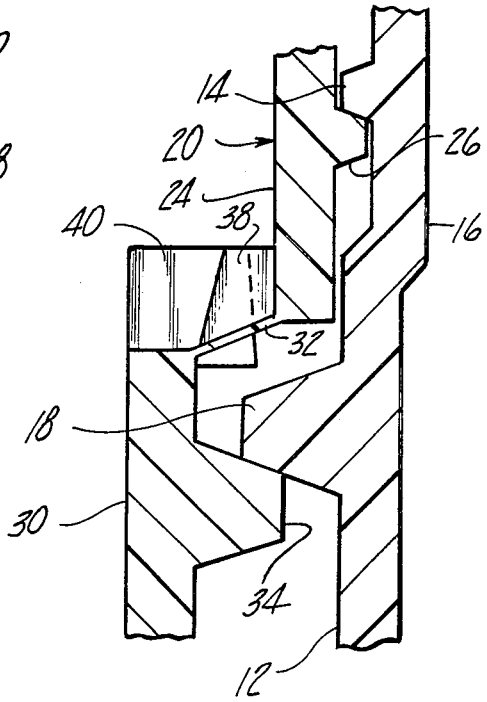
FIG. 2 is a partial side elevation in cross section showing the closure of FIG. 1 with its tamper indicating ring bead in full engagement with a flange on a container to which the closure is applied.
Figure 3:
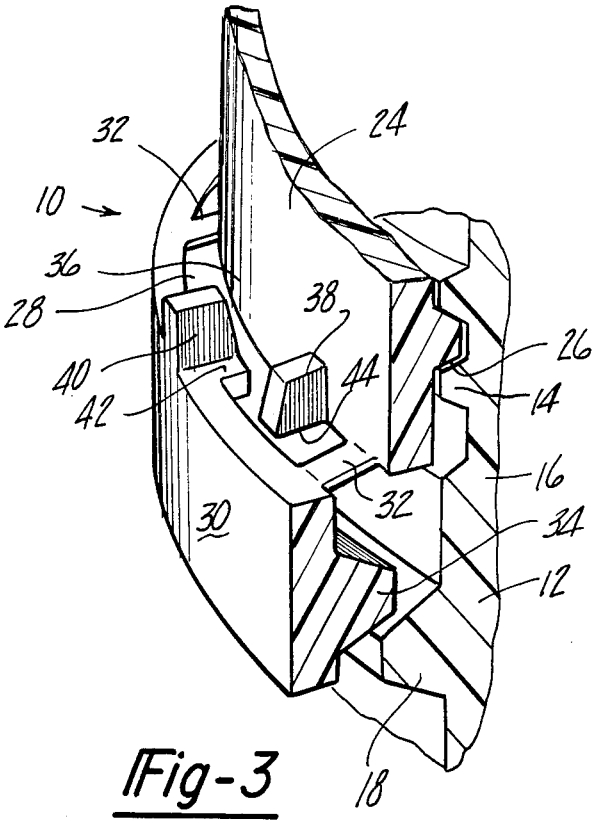
FIG. 3 is a fragmentary perspective view in section showing the skirt and ring drive means in the relaxed position before the application of tightening torque to the cap.

The closure 10 includes an upper cap portion 20 having an end wall 22 and a cylindrical side wall 24 with an internally threaded portion having internal threads 26 engageable with the external threads 14 to hold the closure 10 in closed position on the container 12. The closure 10 also includes a ring element 30 which is disposed concentrically with the cylindrical skirt 24 and is disposed in slightly radially outwardly spaced relation relative thereto. The ring element 30 is joined to the cap portion 20 by a plurality of circumferentially spaced web elements 32. As indicated in FIG. 1, eight equally spaced shear webs 32 can be used. The ring element 30 is also provided with a radially inwardly projecting annular bead 34 engageable with the lower surface 36 of the annular flange 18.

The cap portion 20 and ring element 30 are molded as an integral unit in one piece and the problem to be solved is the application of the closure 10 to the container 12 without fracturing the web elements 32 prematurely. For this purpose, the lower exterior surface 36 of the cylindrical skirt 24 is provided with drive lugs 38 which in the as-molded condition of the tamper indicating closure 10 are slightly spaced from driven lugs 40 formed on the top surface of the ring element 30. A load transmitting land means 42 is formed on the ring element 30 between the drive and driven lugs 38 and 40. The underside of the drive lug 39 forms additional load transmitting land means 44 which during application of the tamper indicating closure 10 to the container 12 come into contact with the land means 42. As indicated in FIG. 1, eight equally spaced pairs of cooperating drive and driven lugs and cooperating land means can be located between adjacent shear webs.

The radial spacing between the concentrically disposed ring element 30 and cylindrical skirt 24 defines an open area 28 between adjacent shear webs 32 into which area drive lug 38 extends radially outward from lower skirt surface 36 and driven lug 40 extends radially inward from the top of ring 30 for engagement with each other in a vertical plane. Horizontally disposed land means 42 is contiguous and extends inward with driven lug 40 from the top of ring 30. Horizontally disposed land means 44 is formed on the underside of drive lug 38 for cooperation with land means 42.

Figure 4:
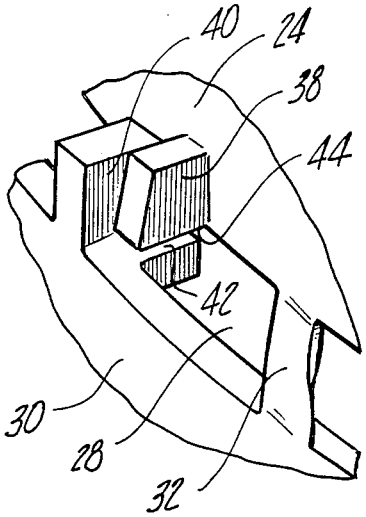
FIG. 4 is a fragmentary perspective view in section showing the skirt and ring drive means in full engagement, as the closure is screwed onto the container.

Upon application of the tamper indicating closure 10 to the container 12, the cap portion 20 is held in capping equipment which is capable of applying a rotational or closing torque while at the same time moving the closure 10 downwardly realtive to the container 12. During such a capping operation, the lower surface of the bead 34 will come into engagement with the top surface of the annular flange 18 to offer frictional resistance to rotation of the ring element 30 relative to the container 12. This causes relative rotation between the ring element 30 and the cap portion 20 which deflects the web elements 32 (see FIG. 4) sufficiently so that the drive lugs 38 come into face-to-face engagement with the driven lugs 40. Similarly, the land means 44 at the underside of the drive lug 38 will come into alignment with the land means 42 on the ring element 30. Subsequent application of capping torque to the cap element 20 causes engagement of the external container threads 14 with internal container threads 26 causing axial downward movement of the tamper indicating closure 10 relative to the container 12. During such rotational and axial movement, the ring element 30 remains stationary relative to the cap portion 20 with the drive and driven lugs 38 and 40 and the land means 42, 44 in engagement with each other. This holds the ring element 30 stationary relative to the cap portion so that both rotational and axial loads can be transmitted without subjecting the web elements 32 to additional loads which might otherwise fracture them. During the application of the rotational and axial forces, the bead 34 is forced over the annular flange 18 so that the bead snaps into position and locks the closure 10 relative to the container 12.

In order to open the container 12, it is necessary to remove the cap portion 20 which can only be accomplished by separating the ring element 30 and the cap portion 20. Such separation requires severing of the web elements 32. This is accomplished by unscrewing the cap portion 20 relative to the container 12. This brings the top surface of the bead 34 into tight engagement with the underside of the annular flange 18 and as the unthreading action continues, the web elements 32 are deflected sufficiently to fracture them so that the cap portion 20 can be completely unthreaded from the container 12 but the ring element 30 is retained by the inner action of the bead 34 and flange 18. Such separation of the ring 30 from the cap portion 20 gives an indication that there has been a prior opening of the container 12 and therefore, possible tampering.

After first opening of the container 12, the cap portion 20 can be reapplied to the container 12 to close the container 12 against spillage of its contents during which time the ring element 30 is retained in position on the container 12, not only to prevent litering but also to give the indication of tampering or initial opening.

The embodiments of the invention in which an exclusive property or privilege is claimed are defined as follows:

1. A one-piece tamper indicating closure for a container having external threads and an annular flange below said threads, said closure comprising: a cylindrical skirt having internal threads complementary to the external threads on said container, a tamper indicating ring spaced radially outward from and extending below said cylindrical skirt defining an open area therebetween, a retaining bead on the inner surface of said ring engageable with the underside of the annular flange on said container to prevent removal of said ring, drive lug means extending radially outward from said skirt into said open area and driven lug means extending radially inward from said ring into said open space in proximate circumferentially spaced relationship to each other, a plurality of shear webs circumferentially spaced from said lug means extending into said open area and joining said skirt and said ring, first land means associated with said skirt and second land means associated with said ring disposed in proximate circumferentially spaced relationship to each other, said lug means and land means being movable circumferentially into engagement with each other, said engagement between lug means being in a radially extending vertical plane, upon application of a capping torque on said skirt and simultaneous engagement of said retaining bead with the top of said annular flange to maintain said ring axially and circumferentially stationary relative to said skirt while said bead is snapped over said annular flange, said webs being sheared upon opening movement of said skirt relative to said ring as said ring is maintained stationary relative to said container to separate said ring and skirt, said ring being retained on said container as said closure is removed.

2. The tamper indicating closure of claim 1 wherein said driven lug means and said second land means on said ring are adjacent to each other and said first land means on said skirt is formed at the underside of said drive lug means.

3. The tamper indicating closure of claim 1 wherein said shear webs are circumferentially spaced from said lug means.

4. The tamper indicating closure of claim 3 wherein said shear webs are deflectable allowing said lug means to move into engagement with each other upon the application of capping torque to said closure.

5. The tamper indicating closure of claim 1 wherein capping torque and axial loads during application of said closure to said container are applied independently of loads on said shear webs.

6. The tamper indicating closure of claim 1 wherein said first land means extends horizontally outward from said skirt into said area and said second land means extends horizontally inward from said ring into said open area.

7. The tamper indicating closure of claim 6 wherein said driven lug means and said second land means on said ring are contiguous and said first land means on said skirt is formed on the underside of said drive lug means.

8. The tamper indicating closure of claim 7 wherein said plurality of shear webs are equally spaced circumferentially around said skirt and said ring, and wherein said drive lug means and said driven lug means includes pairs of individual drive lugs and driven lugs, one pair located in said open area between adjacent shear webs, and wherein said first and second land means includes pairs of individual first lands and second lands, one pair associated with each of said pairs of drive lugs and driven lugs.

9. The tamper indicating closure of claim 8 wherein there are eight shear webs, eight pairs of lugs, and eight pairs of lands.

10. A one-piece tamper indicating closure for use with a container having a threaded neck and an annular flange below the threaded neck, said closure comprising: a cap having an end wall and cylindrical skirt with an internally threaded portion for engagement with said threaded neck, a ring element concentric with said skirt and disposed below and radially outwardly of said skirt, an inwardly projecting annular bead on said ring engageable with the lower surface of said flange on said container when said closure is fully threaded on said container, web elements joining said skirt and said ring to form a one-piece unit, a plurality of equally spaced axial drive lugs extending radially outward along the circumference at the lower end of said skirt, a plurality of equally spaced axial driven lugs extending radially inward along the circumference at the upper end of said ring, said drive lugs and driven lugs being slightly spaced from each other and movable into engagement with each other upon deflection of said web elements as a result of application of a closing torque on said closure and simultaneous engagement of a lower surface of said bead with a top surface of said flange, said engagement being operative to maintain said ring and cap in circumferentially and axially fixed relationship to each other during forcing of said bead over said flange without rupture of said web elements, said web element being breakable upon unthreading of said cap from said container while said ring is maintained stationary to separate said ring from said cap and leave said ring on said container to from said container while said ring is maintained stationary to separate said ring from said cap skirt, said ring being retained on said container to indicate tampering as said closure is removed.

11. The tamper indicating closure of claim 10 further including a plurality of equally spaced horizontally disposed first lands, one formed on the underside of each of said drive lugs and a plurality of equally spaced horizontally disposed second lands, one formed contiguous to each of said driven lugs cooperating with said plurality of first lands.

12. A one-piece tamper indicating closure for use with a container having a threaded neck and an annular flange below the threaded neck, said closure comprising: a cap having an end wall and a cylindrical skirt with an internally threaded portion for engagement with said threaded neck, a ring element concentric with said skirt and disposed below and radially outward of said skirt, an inwardly projecting annular bead on said ring engageable with the lower surface of said flange on said container when said closure is threaded on said container, a plurality of shear webs joining said skirt and ring, a plurality of drive lugs extending radially outward from said skirt, a plurality of driven lugs extending radially inward from said ring, said drive lugs and driven lugs being slightly spaced from each other and movable into engagement with each other upon deflection of said shear webs as a result of the application of a closing torque on said cap and engagement of said bead with said flange during movement of said bead over said flange, said webs being sheared upon unthreading of said cap indicate tampering upon removal of said cap from said closure.

* * * * *